United States Patent [19]

Romansky et al.

[11] Patent Number: 5,025,734

[45] Date of Patent: Jun. 25, 1991

[54] LOCOMOTIVE EQUIPMENT CARRIAGE

[75] Inventors: Michael E. Romansky, North Huntingdon; Robert D. Dimsa, Elizabeth, both of Pa.; Howard R. Munday, Jacksonville, Fla.

[73] Assignee: Westinghouse Air Brake Company, Wilmerding, Pa.

[21] Appl. No.: 518,385

[22] Filed: May 3, 1990

[51] Int. Cl.[5] ..... B61C 17/00

[52] U.S. Cl. ..... 105/26.05; 105/395; 105/463.1

[58] Field of Search ..... 105/26.05, 396, 463.1, 105/61; 213/1.3, 76; 220/507, 510, 528, 529, 534, 542, 544; 224/273, 29.5, 281, 310, 311, 324, 325, 326; 248/56; 285/18, 19, 24, 26, 29, 137.1, 63

[56] References Cited

PUBLICATIONS

"26-Lu Unitized Brake Equipment", Westinghouse Air Brake Catalogue.

*Primary Examiner*—Robert J. Oberleitner
*Assistant Examiner*—Mark T. Le
*Attorney, Agent, or Firm*—G. J. Falce

[57] ABSTRACT

An equipment carriage for locomotive air brake valve components including a box-like frame having a rear section separating parallel end sections. The frame is arranged to guidably receive, through an open front section, a group of one or more unitized valve assemblies stacked in vertical, side-by-side relationship, such that an end face adjacent the rear section engages a mating face of a respective header bar that is affixed to the frame at the rear section thereof to provide a pipe bracket to which the locomotive air lines are connected. Such an arrangement, in addition to providing optimum space utilization, permits removal of individual unitized assemblies from the frame without requiring removal of the frame itself or any of the other unitized assemblies, and without disturbing the air line connections.

21 Claims, 4 Drawing Sheets

LOCOMOTIVE EQUIPMENT CARRIAGE

BACKGROUND OF THE INVENTION

The present invention relates to equipment carriages that provide for remote mounting of locomotive air brake valve components in a unitized assembly.

Such equipment carriages make it possible to locate most of the air brake valve components remotely from the locomotive cab, while retaining easy access for service and maintenance purposes. A special compartment housing the equipment carriage is generally provided below the locomotive cab floor.

Known equipment carriages of the above type are portable and employ a single, laminated pipe bracket on one face of which is mounted the air brake valve components. Air connections between the various valve components are made through internal passages of this laminated pipe bracket, which is secured to the equipment carriage. The portable equipment carriage is rolled into position on tracks in the equipment carriage compartment. Rollers, on which the equipment carriage rides, are adjustable so that openings in the opposite face of the laminated pipe bracket are aligned with corresponding passages in the mating face of a horizontally-disposed pipe manifold that is permanently fixed in the equipment carriage compartment. This pipe manifold provides a primary pipe bracket having pipe fittings to which the locomotive air lines are permanently connected. In this manner, air is connected to the various air brake valve components. When it is desired to perform maintenance or service on the air brake valve components, the entire portable equipment carriage is simply removed from the equipment carriage compartment without disturbing the locomotive pipe connections at the pipe manifold. A serviceable unit is then installed and the removed unit is returned to a repair facility for servicing, as required. Consequently, the locomotive down time is limited to the time required to remove and install the portable equipment carriage. This represents a considerable cost-savings in terms of the locomotive down time, as compared to performing "on site" service.

In that one face of the laminated pipe bracket serves as the mating face for the primary pipe bracket, only a single face of the laminated pipe bracket is available for mounting the various air brake valve components. Such an arrangement is limiting in terms of the number of valve components that can be accommodated by the equipment carriage, which is in turn limited by the size of the equipment carriage compartment.

Moreover, handling of the portable equipment carriage during installation and removal, as well as during service in the repair facility, is cumbersome due to the weight and bulk of the unit. For this reason, the assistance of a forklift is normally enlisted, which tends to offset any cost-savings capable of being realized.

SUMMARY OF THE INVENTION

An object of the present invention, therefore, is to provide an equipment carriage in which the locomotive air brake valve components are packaged to more efficiently utilize space availability.

Another object of the invention is to package the equipment carriage in such a manner as to facilitate handling of the locomotive air brake valve components of the equipment carriage during servicing and maintenance.

Still another object of the invention is to provide for automatically establishing electrical, as well as pneumatic, connections simultaneously through the equipment carriage.

Briefly, these objectives are carried out in the present invention by providing an equipment carriage including a frame having spaced-apart end sections separated by a rear section to which at least one header bar is affixed to receive the locomotive air lines. A plate member having parallel, opposing, mounting faces, on which the locomotive air brake valve components are carried, is positioned vertically between the frame end sections, with the mounting faces of the plate member being disposed parallel to the end sections. This provides for an end face of the plate member to be engaged with a mating face of the header bar to establish a fluid pressure connection between passages in the header bar, to which the locomotive air lines are connected, and passages in the adjoining plate member, to which the locomotive air brake valve components are connected.

BRIEF EXPLANATION OF THE DRAWINGS

These and other objects and attendant advantages of the invention will become apparent from the following more detailed explanation of the invention when taken in conjunction with the accompanying drawings in which.

DESCRIPTION AND OPERATION

Figure 1:
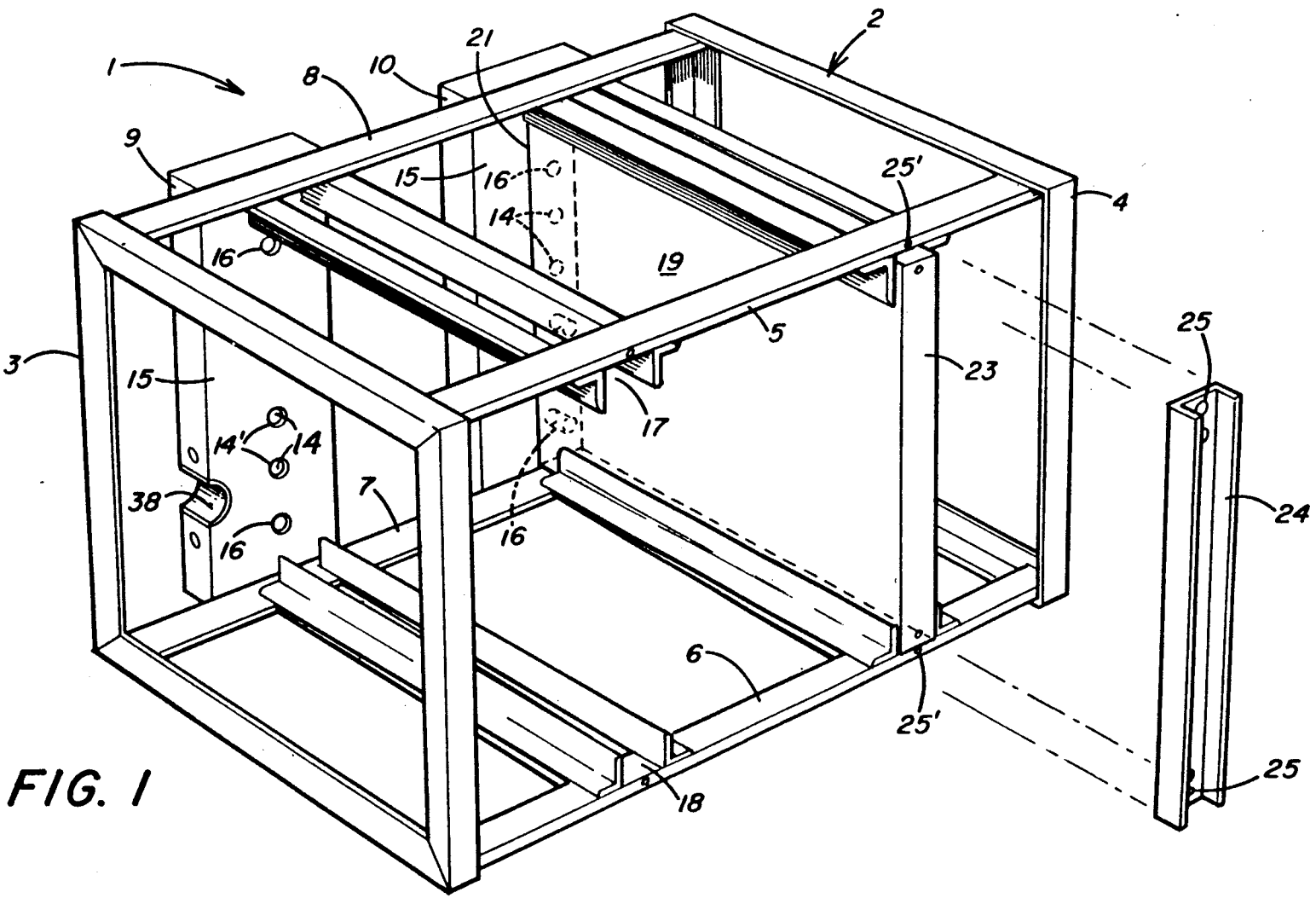
FIG. 1 is an axonometric view of a portable equipment carriage arranged to accommodate multiple unitized assemblies.
Figure 2:
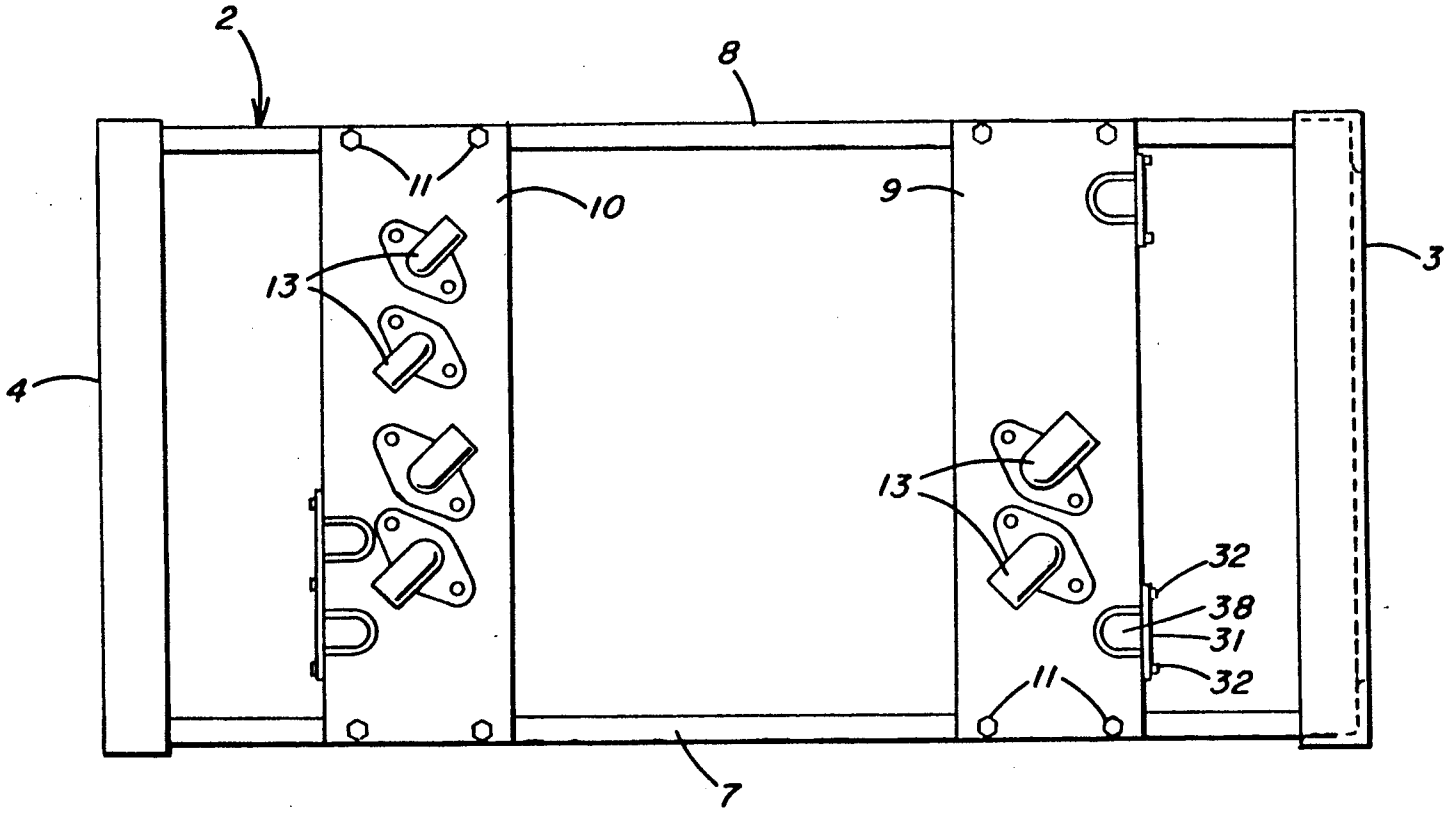
FIG. 2 is an elevation view showing the back side of the equipment carriage of FIG. 1.

Referring now to FIG. 1 of the drawings, there is shown an equipment carriage 1 including a box-like frame 2 having rectangularly-shaped ends 3, 4 fabricated from angle iron. Four lengths of bar stock 5, 6, 7 and 8 are interconnected between corresponding points of rectangular ends 3 and 4 approximate the corners thereof. Connecting bars 5 and 6 are preferably set back a short distance from their respective corners for a purpose hereinafter explained. Multiple-header bars 9, 10 are secured to the rear side of frame 2 by cap screws 11 that pass through the respective header bars and screw into threaded openings in connecting bars 7 and 8, as can be seen in FIG. 2. The frame is sized to fit in the air brake equipment locker of a locomotive and is secured in place, as by welding.

Each header bar 9, 10 is formed with internal air passages to which the locomotive air lines are connected by means of pipe fittings 13 that are bolted to the back side of the header bars, as also shown in FIG. 2.

These header bars thus serve as primary pipe brackets, with the air passages terminating in openings 14 at a face portion 15 of the respective header bars, and are fit with seals, such as ring gaskets (not shown), that lie in an annular recess 14' surrounding the openings of these passages. In addition, each header bar is provided with guide holes 16 having bushed bores in the face 14 of the header bars adjacent their upper and lower ends, as viewed in FIG. 1.

An upper guideway 17 and a lower guideway 18 associated with each header bar 9, 10 extends from the front to the back of frame 2 to guidably receive a secondary pipe bracket in the form of a plate member 19 that is vertically disposed in frame 2, such that an end face 21 adjoins face portion 15 of a respective header bar, one such secondary pipe bracket being shown in FIG. 1 and the other omitted to better show the respective guideways. These guideways 17 and 18 may be formed from angle iron members that are welded in spaced-apart relationship to the connecting bars 5, 6, 7 and 8 of frame 2. Preferably, these angle iron members are so situated as to form a guideway that is tapered slightly so as to converge from front to rear in order to guide the secondary pipe bracket horizontally toward initial alignment with a respective header bar 9, 10.

Each plate member 19 is preferably laminated, but may be cast, and has a plurality of air brake valve components mounted on its opposite faces to provide a unitized assembly 20. Internal passages of plate member 19 establish fluid pressure communication between the air brake valve components and end face 21.

the unitized assemblies are mounted in side-by-side relationship, each aligned with a respective header bar with which an end face 21 is engageable at face portion 15 to provide an air connection therebetween. In mounting the locomotive air brake valve components on both side faces of the pipe brackets, the number of valve components that can be accommodated in the limited space available is maximized. Moreover, the arrangement in accordance with the present invention allows the frame 2, including the attached header bars 9, 10, to remain secured in the equipment locker with the locomotive air line connections intact, so that only the unitized assemblies 20 need to be removed when maintenance and/or servicing of a valve component is required. Such an arrangement also simplifies installation and removal of the unitized assemblies 20, since each individual unitized assembly 20 is relatively small in size and light in weight, as compared to a single unitized assembly presently known in the art.

Figure 6:
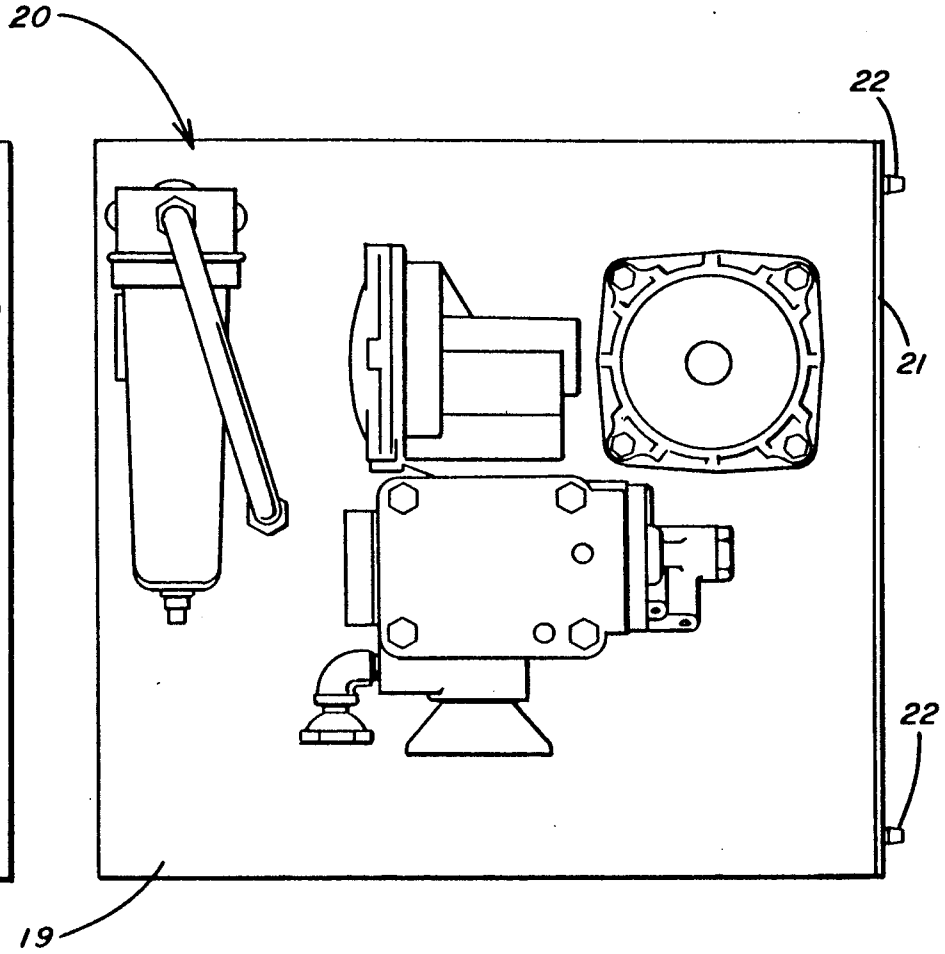
FIG. 6 is an elevation view showing the opposite side of the secondary pipe bracket segment of FIG. 5.
Figure 5:
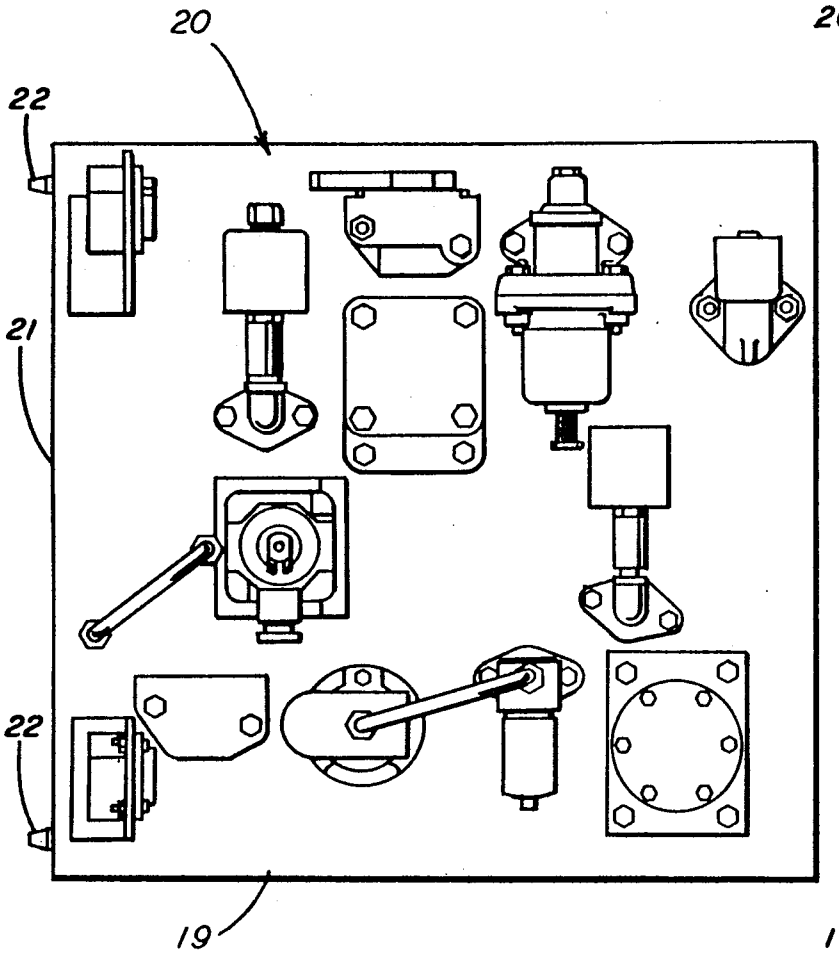
FIG. 5 is an elevation view showing the valve components mounted on one side of a secondary pipe bracket suitable for use in the equipment carriage of FIG. 1.

In FIGS. 5 and 6 is shown a unitized assembly 20 comprising plate member 19 and a plurality of locomotive air brake valve components that are mounted on both side faces, some being pneumatic and others being electropneumatic. These valve components of unitized assembly 20 have been omitted from plate member 19 in FIG. 1 for the purpose of clarity.

Installation of unitized assembly 20 is made by sliding plate member 19 vertically into guide channels 17-18 so that end face 21 is guided horizontally toward engagement with header bar face 15, as previously mentioned. As the mating faces 15, 21 of header bar 10 and plate member 19 approach engagement, a pair of dowel pins 22 having conical heads that project from end face 21 enter the bushed guide holes 16 in header bar face 15 to achieve final, all-directional alignment, in which the header bar openings match up with corresponding openings in end face 21 of plate member 19 to establish the pneumatic connection to the air brake valve components.

A clamping member 24, the opposite ends of which extend beyond the top and bottom of the plate member 19, is connected to the opposite end 23 of plate member 19 by suitable fasteners, such as cap screws (not shown). Following the aforementioned final alignment of plate member 19 with header bar 10, additional cap screws (not shown) are passed through oversized holes 25, which are drilled into the clamping bar extensions. The cap screws are screw-threaded into tapped holes 25' in top and bottom connecting bars 5, 6 to draw the pipe bracket up flush into tight face-to-face engagement with header bar 10, in order to compress the ring gasket seals in recesses 14' of openings 14 and thereby assure a pressure-tight junction between the header bar and the plate member. The oversized holes 25 are provided to allow plate member 19 to adjust itself, as required, member 24, thereby assuring flush, face-to-face engagement with header bar 9, 10, to positively secure the unitized assembly in place. It will now be appreciated that in setting connecting bars 5 and 6 back slightly from the front corners of the rectangularly-shaped ends 3 and 4 of frame 2, as previously mentioned, the opposite end 23 of plate member 19 extends slightly forward from these frame members 5 and 6. Consequently, a gap is formed between connecting bars 5, 6 and the extensions of clamping member 24 to allow the pipe bracket to be drawn up tight enough to obtain a clamping force sufficient to achieve O-ring seal compression, and thus maintain the integrity of the pressure seal at the header bar/plate member.

It will also be appreciated that the configuration of pneumatic connections between specific laminate assembly/header bar combinations may differ, depending upon the valve components required to be mounted on a particular plate member. In FIG. 2, for example, it can be seen that header bar 9 accommodates only two pipe connections; whereas, header bar 11 has four pipe connections. In order to assure the propriety of a particular unitized assembly/header bar combination, indexing can be provided by strategically locating the dowel pins 22 and their complimentary alignment holes 16 to prevent unitized assembly/header bar interchangeability.

Figure 4:
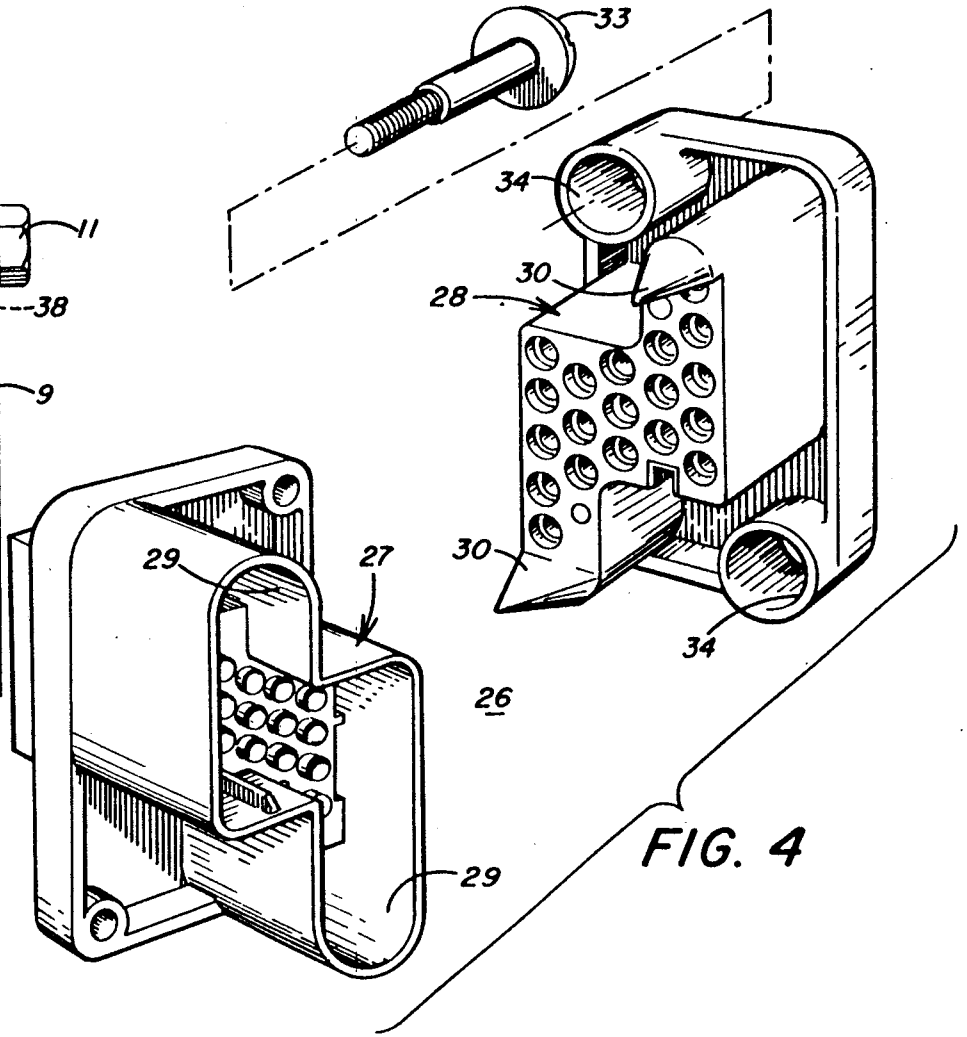
FIG. 4 is an axonometric view showing the respective male and female portions of the electrical connector of FIG. 3.

In addition to the pneumatic connections established by the mating of a specific plate member 19 with the appropriate header bar 9 or 10, electrical connections are also provided concurrently with installation of a unitized assembly. A conventional, off-the-shelf, electrical connector 26, as shown in FIG. 4, may be employed to provide the electrical connections. Such a connector consists generally of a female portion 27 and a male portion 28 conforming generally in size and shape to that of female portion 27. Formed within female portion 27 are alignment holes 29 adapted to receive projections 30 of male portion 28 preliminary to male portion 28 entering female portion 27. Projection 30 is tapered at its forward end in order to take up misalignment between the male and female portions and thereby assure initial alignment therebetween preliminary to the final alignment, at which point the electrical connections are made concurrently with establishment of the pneumatic connections.

Figure 3:
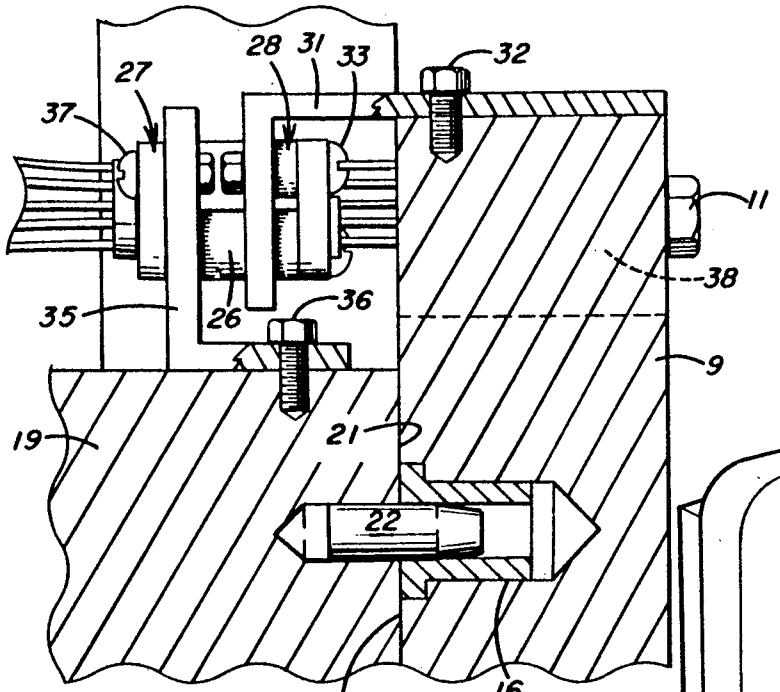
FIG. 3 is a plan view of the equipment carriage of FIG. 1, partly in section, showing the electrical connectors via which electrical communication is established when a respective unitized assembly is installed in place.

The means for providing such an electrical connection is illustrated in FIG. 3, wherein an angle bracket 31 is shown connected by cap screws 32 to one side of header bar 9. A pair of suitable fasteners, such as shoulder screws 33, connect the male portion 28 of connector 26 to bracket 31. The shank diameter of these shoulder screws 33 is less than the diameter of openings 34 in male portion 28, through which they pass, thereby providing for floating, all-directional movement of male portion 28 relative to bracket 31 to which screws 33 are fastened. Another angle bracket 35 is connected by cap screws 36 to the side of a plate member 19 with which header bar 9 is mated. A pair of suitable fasteners, such as machine screws 37, connect the female portion 27 to angle bracket 35. The position of the angle brackets locates the male and female portions of electrical connector 26 to establish full engagement therebetween when final alignment occurs during mating contact between plate member 19 and header bar 9. In addition, header bar 9 is formed with a cut-away portion 38 in its side in the area of angle bracket 31. This, in effect, forms a conduit through which the wires of electrical connector 26 are passed. When bracket 31 is bolted in place, it covers the cut-away portion 38 to retain the electrical connector wires in place.

In establishing pneumatic connections through face-to-face mating of header bars 9, 10 with the end face of a respective unitized plate member, it will be appreciated that side-by-side stacking of plural, segmented, unitized assemblies 20 is achieved. This, in turn, makes possible better space utilization by accommodating mounting of the air brake valve components on both sides of the unitized assemblies. Moreover, the individual, segmented, unitized assemblies are easier to handle than a larger, single unitized assembly, because of their smaller size and lighter weight. When service and/or maintenance is required on a specific valve component or group of valve components, only the unitized assembly having the specific valve or group of valve components needs to be removed. Such removal, of course, can be accomplished without in any way disturbing any other unitized assembly or the pipe connections at the header bars. This gives rise to the possibility of grouping valve components on a particular unitized assembly according to similar maintenance requirements or according to different functional requrements.

We claim:

1. An equipment carriage adapted for installation on a locomotive and having a unitized assembly including the locomotive air brake valve components with which the locomotive fluid pressure conduits are communicated, said equipment carriage comprising:

(a) a box-like frame having spaced-a sections, a front section, and a rear section;

(b) at least one primary pipe bracket affixed to said rear section of said frame and having fittings to which said fluid pressure conduits are connected, a face portion facing said front section of said frame, and passages interconnected between said fittings and said face portion; and (c) at least one said unitized assembly removably mounted in said frame comprising:

(i) said locomotive air brake valve components; and (ii) a secondary pipe bracket in the form of a rectangular plate member having opposing sides on which said air brake valve components are mounted, an end face adjoining said face portion of said primary pipe bracket, and passages interconnected between said end face and said air brake valve components, said plate member having a vertical disposition in said frame with said opposing sides thereof being substantially parallel to said end sections of said frame, said passages in said primary pipe bracket and said plate member being aligned to provide flow paths via which said fluid pressure communication between said conduits and said air brake valve components is established when said face portion and said end face are in face-to-face engagement.

2. An equipment carriage, as recited in claim 1, further comprising guide means for providing said alignment of said passages in said plate member with said passages in said primary pipe bracket so as to establish said fluid pressure communication between said fluid pressure conduits and said locomotive air brake valve 3. An equipment carriage, as recited in claim 2, wherein said guide means comprises a first set of spaced-apart guide rails fixed to the top of said frame so as to form an upper guideway extending between said front and rear sections of said frame, and a second set of spaced-apart guide rails fixed to the bottom of said frame so as to form a lower guideway extending between said front and rear sections of said frame, said first and second sets of guide rails guidably receiving said plate member to provide initial alignment thereof with said primary pipe bracket.

4. An equipment carriage, as recited in claim 3, wherein said upper and lower guideways each converge from said front section toward said rear section of said frame to provide said initial alignment in a horizontal direction.

5. An equipment carriage, as recited in claim 4, further characterized in that said upper and lower guideways lie in a plane substantially parallel to said side sections of said frame.

6. An equipment carriage, as recited in claim 5, wherein said guide means further comprises at least one dowel pin in one of said primary pipe bracket and said plate member and a corresponding number of alignment openings in the other of said primary pipe bracket and said plate member.

7. An equipment carriage, as recited in claim 6, wherein said at least one dowel pin is a first dowel pin and a second dowel pin spaced vertically from each other.

8. An equipment carriage, as recited in claim 7, wherein said first and second dowel pins have a conical head to provide final, all-directional alignment of said plate member with said primary pipe bracket.

9. An equipment carriage, as recited in claim 3, further characterized in that said upper and lower guideways lie in a plane substantially parallel to said side sections of said frame.

10. An equipment carriage, as recited in claim 9, further comprising clamping means for retaining said at least one said unitized assembly in said frame.

11. An equipment carriage, as recited in claim 10, wherein at least said front section of said frame is open, said clamping means comprising a clamping member that is removably connected to said frame so as to traverse said open front section thereof.

12. An equipment carriage, as recited in claim 11, wherein said clamping member is further connected to said plate member such as to traverse said open front section of said frame in a direction parallel to said opposing sides of said plate member.

13. An equipment carriage, as recited in claim 12, further comprising seals surrounding said passages at the openings thereof at said primary pipe bracket, said seals being compressible between said end face of said plate member and said face portion of said primary pipe bracket.

14. An equipment carriage, as recited in claim 13, wherein said plate member projects beyond said front section of said frame when said end face is engaged with said face portion of said primary pipe bracket to assure said compression of said seals by said connection of said clamping member to said frame.

15. An equipment carriage, as recited in claim 1, wherein certain ones of said locomotive air brake valve components are electrically operated, said equipment carriage further comprising electric connector means for connecting wires in the locomotive to wires leading to said certain ones of said air brake valve components when said unitized assembly is installed in said frame.

16. An equipment carriage, as recited in claim 15, wherein said electrical connector means comprises:

(a) a male portion affixed to said primary pipe bracket and having said locomotive wires connected thereto; and (b) a female portion affixed to said plate member and having wires leading to said certain ones of said locomotive air brake valve components connected thereto.

17. An equipment carriage, as recited in claim 16, wherein said male and female portions are positioned relative to each other to establish initial alignment therebetween prior to said engagement of said end face of said plate member with said face portion of said plate member.

18. An equipment carriage, as recited in claim 17, wherein said male and female portions comprise mutual alignment means for providing final alignment therebetween at the time said end face of said plate member engages said face portion of said primary pipe bracket.

19. An equipment carriage, as recited in claim 18, wherein said primary pipe bracket further comprises a conduit through which said locomotive wires are directed for connection with said male portion.

20. An equipment carriage, as recited in claim 1, wherein said at least one unitized assembly is two separate unitized assemblies mounted in said frame in spaced, side-by-side relationship.

21. An equipment carriage, as recited in claim 20, wherein said at least one primary pipe bracket is two separate primary pipe brackets with which said plate members of said two separate unitized assemblies are engageable respectively.

* * * * *